United States Patent [19]

Schweitzer

[11] 4,195,404

[45] Apr. 1, 1980

[54] CUTTING MACHINE WITH AN OSCILLATING KNIFE

[75] Inventor: Walter Schweitzer, Stuttgart, Fed. Rep. of Germany

[73] Assignee: Krauss u. Reichert GmbH & Co. KG Spezialmaschinenfabrik, Fellbach, Fed. Rep. of Germany

[21] Appl. No.: 887,676

[22] Filed: Mar. 17, 1978

[30] Foreign Application Priority Data

Mar. 23, 1977 [DE] Fed. Rep. of Germany ..... 2712673

[51] Int. Cl.[2] ..... B26D 7/12

[52] U.S. Cl. ..... 30/139; 30/275; 51/249

[58] Field of Search ..... 30/139, 273, 275; 51/249; 83/174

[56] References Cited

U.S. PATENT DOCUMENTS

| | | | |
|---|---|---|---|
| 927,689 | 7/1909 | Simon | 30/139 |
| 1,462,650 | 7/1923 | Maimin | 30/275 |
| 1,678,989 | 7/1928 | Maimin | 30/275 |
| 1,935,155 | 11/1933 | Komow | 30/275 |
| 2,010,967 | 8/1935 | Simon | 30/275 X |
| 2,282,918 | 5/1942 | Zawistowski | 51/249 |
| 2,529,441 | 11/1950 | Zawistowski | 51/249 |
| 2,603,862 | 7/1952 | Komow | 30/139 |
| 3,583,265 | 6/1971 | Renger | 51/249 X |

*Primary Examiner*—Gary L. Smith
*Attorney, Agent, or Firm*—Shenier & O'Connor

[57] ABSTRACT

In a cutting machine of the type having a vertically reciprocating cutting blade, an internal grinder and a presser foot on a carrier bar, a lifting device responsive to operation of an actuating member for stopwise lifting the carrier bar to permit true one-hand operation and to avoid possible injury to an operator placing his hand on the presser foot in the region of the reciprocating cutter blade.

10 Claims, 7 Drawing Figures

CUTTING MACHINE WITH AN OSCILLATING KNIFE

SUMMARY OF THE INVENTION

The invention relates to a cutting machine with an oscillating knife comprising a motor mounted in a housing for driving a lengthwise oscillating knife with a cutting edge, further comprising a displaceable grinding device, means mounted at the housing for guiding said grinding device in the longitudinal direction of the knife, said grinding device having at least one grinding element which can be brought into contact with a side surface of the cutting edge of the knife, said grinding element being made to circulate by a drive means coupled to the motor, further comprising an advancing device drivable by the drive means for advancing the grinding device, and having as first advancing member a spindle extending in the direction of displacement of the grinding device, and at least one second advancing member interacting with the spindle along a helical path located at the circumference of the spindle, the two advancing members being displaceable relative to each other in the direction of displacement of the grinding device and one of the two advancing members being fixedly coupled with the grinding device in the direction of displacement of the latter.

Cutting machines with an oscillating knife, particularly cutting machines guided manually on a table, are used for cutting several superimposed layers of cloth, foil, leather and the like, and depending on the nature of the material to be cut, the cutting edge of the knife must be sharpened again after long or short periods of time. In principle, there are two types of cutting machines comprising an oscillating knife and a grinding device, and in both types the grinding element can be driven by the motor of the cutting machine. In the simple embodiments the grinding device must, however, be lowered and raised again manually, while in relatively complicated cutting machines of the first aforementioned kind the motor can also drive a drive means for lowering and raising the grinding device. This drive means comprises a friction wheel which can be brought into contact with a crank disc located on the motor axis for driving the oscillating knife, and drives a worm gear which ensures that the rotational speed of the friction wheel is reduced to a relatively great extent. A vertical drive spindle extends from this worm gear to a further gearing of the grinding device which is mounted in the region of the grinding element, and via which the grinding element and a likewise vertically extending cross thread spindle are driven. The grinding device is lowered and raised via this cross thread spindle, and for the two counter-rotating threads of the cross thread spindle there are two corresponding nuts, one of which is prevented from rotating together with the cross thread spindle during the downward movement of the grinding device and the other during its upward movement. The cross thread spindle and the two nuts therefor form advancing members within the meaning of the definition used at the beginning. Since the two counter-rotating threads of the cross thread spindle must be machined with a relatively large minimum pitch, in order to ensure perfect functioning a relatively high reduction in speed is required for driving the cross thread spindle, otherwise the grinding device would reciprocate too rapidly. For spatial reasons, a high reduction of speed can, however, not be effected in the grinding device, in the region of its grinding element, so that most of the reduction in speed must be effected beforehand, for example, in the aforementioned worm gear. This, in turn, has the disadvantage that the grinding element rotates relatively slowly. Moreover, the above description of the known construction shows that the latter is of extremely elaborate design.

The object underlying the invention was to create a cutting machine with an oscillating knife comprising a grinding device which need not be displaced manually, and being of a simpler design than the known cutting machine with an oscillating knife comprising a grinding device which is displaceable by a motor. Departing from a cutting machine of the first aforementioned kind this object is attained in accordance with the invention by the spindle being of cylindrical configuration in the region of the helical path and the second advancing member in the form of a friction wheel abutting the spindle, and furthermore by the friction wheel axis being inclined with respect to the spindle axis. Gearing which is known per se is used in the inventive cutting machine, however, this gearing was hitherto only used in relatively large machines with advancing lengths of approximately 2 meters and more. Use of this gearing principle in an apparatus such as a cutting machine with an oscillating knife, which is to be classified in the field of precision mechanics, was therefore not rendered obvious by the known gearings.

The inventive construction not only has the advantage that no thread need be machined on the spindle, but, what is much more important, the inclination of the friction wheel axis with respect to the spindle wheel axis can be chosen almost as small as desired, without resulting functional disturbances, and consequently, the spindle can be driven at a high rotational speed without having the disadvantage of rapid reciprocation of the grinding device. Therefore, contrary to the known construction, the grinding element of the grinding device in the inventive cutting machine can also be driven at a high rotational speed.

The grinding device must, of course, not necessarily be guided in or at the motor housing—it is, for example, conceivable to guide the grinding device at the knife guide means extending along the knife, so that within the meaning of the definition of the invention the knife guide means is to be considered part of the housing. Grinding wheels and also endless grinding belts can be used as grinding elements.

In principle, there are two different ways of both lowering and raising the grinding device by a motor without reversing the direction of rotation of the spindle: In a preferred embodiment of the inventive cutting machine the friction wheel axis is pivotable between two positions in which it is inclined with respect to the spindle axis in opposite directions, so that the grinding device is lowered in one position of the friction wheel axis and raised in the other position. Two friction wheels with axes which are oppositely inclined with respect to the spindle axis could, however, also be provided and the two friction wheels made to abut the spindle alternately so as to lower the grinding device with one friction wheel and raise it with the other.

It is expedient to mount two friction wheels whose axes are inclined in opposite directions with respect to the spindle axis on either side of the spindle, so that they rest thereagainst and are fixedly coupled with each other in the longitudinal direction of the spindle. This avoids one-sided pressure being exerted on the spindle by one single friction wheel. The absolute value of the angle which the friction wheel axes make with the longitudinal direction of the spindle can, of course, only be exactly the same for both friction wheels if these are located exactly opposite each other with respect to the spindle axis. Upon reversal of the advance direction of the grinding device both friction wheel axes are then pivoted in the aforementioned manner.

In principle, it is irrelevant whether the friction wheels or the spindle is coupled with the grinding device in the direction of displacement. However, the cutting machine is structurally simpler if the friction wheels are mounted on the housing and the spindle is displaced together with the grinding device, as will be explained in the following description of a preferred embodiment of the inventive cutting machine.

In order that the lowering of the grinding device is not hindered by a so-called material presser foot, i.e., by a member resting on the material to be cut and surrounding the cutting edge of the oscillating knife in a fork-shaped manner, it is recommended that a locking device adjustable between an operative and an inoperative position be provided for the drive means such that it can only assume its inoperative position when the material presser foot is fully lowered. Since the material presser foot is normally mounted on a bar extending in the longitudinal direction of the knife and displaceably guided in this direction at the housing, the construction is particularly simple if the locking device comprises a projection extending into the path of the material presser foot bar when the locking device is in its inoperative position. Depending on the arrangement of this projection one could provide in the material presser foot bar a recess which the projection can engage when the locking device is in its inoperative position, however, it is simpler if the projection extends over the upper end of the material presser foot bar when the material presser foot is lowered. The grinding device can therefore only be switched on when the material presser foot is in its lower end position.

In the simple embodiment of the known cutting machines wherein the grinding device must be lowered and raised again manually, it is already known to provide the grinding element with an endless drive belt which runs over a wheel of a drivable axis which can be coupled with the motor, over a wheel mounted stationarily in the housing, and over two wheels which are displaceable with the grinding device. The belt drive is of fully symmetrical design, for not only two friction wheels which can be brought into contact with a motor-driven crank disc are provided, but each friction wheel axis carries a wheel for the drive belt and a flight of the drive belt extends from each of these wheels downwardly over a wheel mounted stationarily in the housing, from there upwardly over a wheel displaceable with the grinding device, from there downwardly again to one respective drive wheel for grinding elements and from there upwardly to a wheel mounted stationarily in the housing.

In accordance with the invention such a belt drive can be simplified by one flight of the drive belt extending directly from the driven axis to the displaceable wheel which drives the grinding element, by the other flight extending over the wheel mounted stationarily in the housing to the other displaceable wheel, and by the spindle being drivable via a wheel displaceable with the grinding device, and via the drive belt. In this construction, however, not only the belt drive for the grinding element is simpler than in the known cutting machine, but at the same time the spindle of the advancing device for the grinding device is driven via the drive belt. For the above explained reasons, the resulting relatively high rotational speed of the spindle is not detrimental.

In hitherto existing cutting machines with an oscillating knife and a so-called material presser foot mounted on a carrier bar which extends in the longitudinal direction of the knife and is displaceable in this direction at the housing, a clamping device is normally mounted to hold the material presser foot at a certain level once it has been raised. Pivoted at the housing is a lever with which the clamping device can be released, so that the material presser foot is made to fall down by its own weight either into its lower end position or during the cutting operation onto the uppermost layer of cloth or the like. The first disadvantage of these known cutting machines is that during operation the machine has to be held and the lever for the clamping device actuated by one and the same hand, and the other hand has to be extended in front of the oscillating knife to grasp and lift the material presser foot, so not only are both hands required for operation, but, in addition, one hand has to be extended into the danger area around the oscillating knife.

When curves and corners are cut in a pile of material by a cutting machine with an oscillating knife, the material becomes warped in the region of the oscillating knife. In the case of normal materials, artificial leather and the like, the material presser foot, made to rest on the material to be cut by its own weight when the clamping device is released, is raised by this material. However, if very light fluffy materials are cut, the latter are not able to raise the material presser foot, which makes it more difficult to cut narrow curves and corners.

In a cutting machine with an oscillating knife comprising a motor mounted in a housing for driving a lengthwise oscillating knife extending in a substantially vertical direction, further comprising a material presser foot mounted on a carrier bar extending in the longitudinal direction of the knife and displaceably guided in this direction at the housing, and further comprising an actuating member mounted at the housing to release a support means for the carrier bar, these disadvantages are eliminated in accordance with the invention, in that the actuating member is also coupled with a lifting device for lifting the carrier bar in a stepwise manner. This stepwise lifting is easiest to achieve by a transportation member actuated by the actuating member frictionally or positively engaging the carrier bar. This results in a cutting machine with genuine one-hand operation eliminating contact with the danger area around the oscillating knife and during the cutting of narrow curves and corners the material presser foot can be raised by a very precise amount in the simplest way.

The design could be selected such that on moving the actuating member in one direction the support means is released, and when it is moved in the other direction and the holding force of the support means is overcome, the lifting device is actuated. In most cases, it should, however, be more expedient for the actuating member to be moved in only one direction, and it is then advisable to design the construction such that the actuating member is adjustable from a position of rest to a second position via an intermediate position, the support means being released in said second position, and such that the lifting device is actuatable by adjustment of the actuating member from its position of rest to the intermediate position, the holding force of the support means in the upward lifting direction then being overcome.

The lifting device is simplest of all, if it comprises a pawl actuatable by the actuating member and engaging toothing on the carrier bar, for if the toothing is correspondingly designed, actuation of the lifing device then readily ensures that the holding force of the support means is overcome. The pawl can also be used in the simplest way to release the support means, and in a preferred embodiment of the inventive cutting machine, the pawl upon effecting a stroke which exceeds the normal stroke, disengages the toothing of the carrier bar and releases the support means, which is particularly easily achieved if the support means is a projection engaging the toothing of the carrier bar by the action of a spring and being forced out of the toothing by the pawl when the latter effects a stroke which exceeds the normal stroke.

Further features, advantages and details of the invention are to be found in the enclosed claims and/or the following description and the enclosed drawings of a preferred embodiment of an inventive cutting machine with an oscillating knife.

DESCRIPTION OF THE PREFERRED EMBODIMENT

Figure 1:
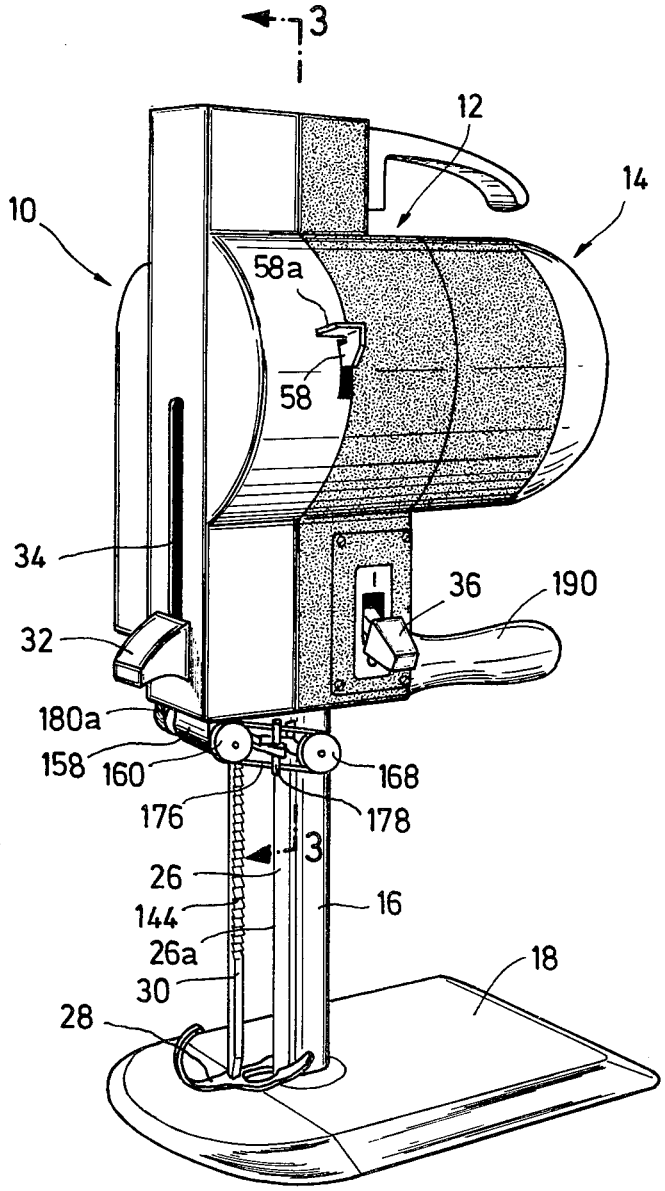
FIG. 1 is a diagrammatic representation of an inventive cutting machine with an oscillating knife, from one side thereof.
Figure 2:
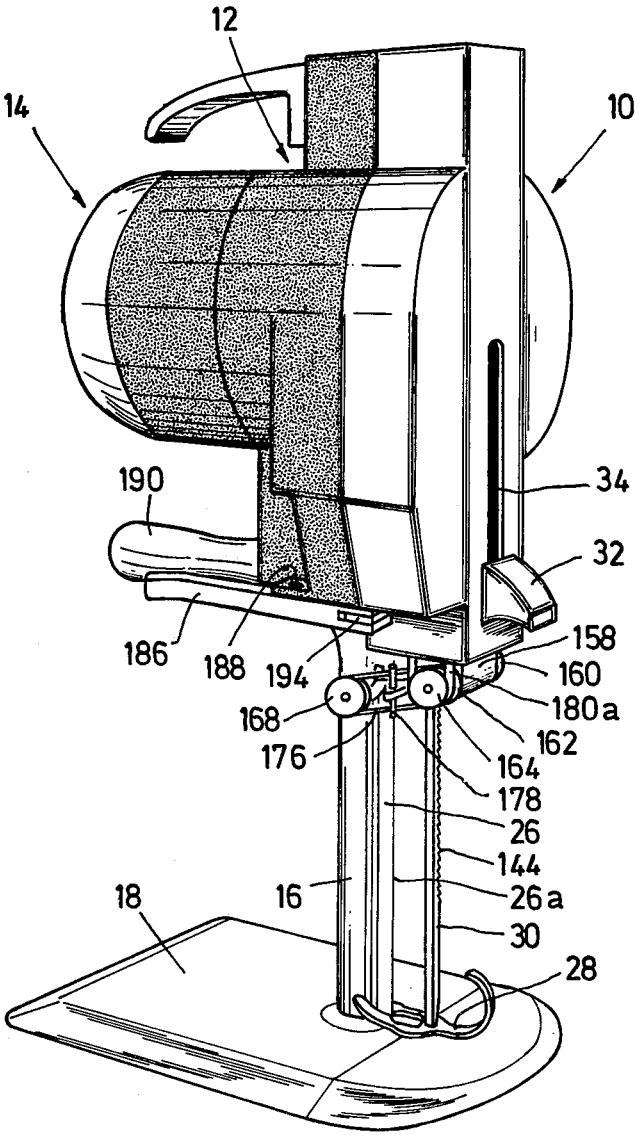
FIG. 2 is a diagrammatic representation of the machine from the other side.

FIGS. 1 and 2 show a cutting machine with an oscillating knife comprising a housing consisting essentially of a front housing shell 10, a rear housing shell 12 and a cap 14. The housing is held by a support 16 on a footplate 18, said support being of U-shaped cross-sectional configuration and serving as a knife guide means, and rollers, which are not illustrated, being mounted on the bottom of said footplate to enable easy displacement of the cutting machine on a table. A crank disc 22 which drives the oscillating knife 26 guided in the support 16 via a connecting rod 24 such that the knife effects an oscillating movement in the vertical direction, is secured to the drive shaft 20 (shown in FIG. 4) of an electric motor which is located beneath the cap 14 and in the rear housing shell 12. This oscillating knife comprises a cutting edge **26*a* which is shielded to a certain extent by a material presser foot 28 and a bar 30 carrying the latter, thus decreasing the danger of an attendant's hands becoming injured while working with the cutting machine. A handle 32 extending through a longitudinal slit 34 in the front housing shell 10 is attached to the material presser foot bar 30 to aid lifting or lowering thereof. A switch 36** serves to switch on the electric motor, which is not illustrated.

Figure 3:
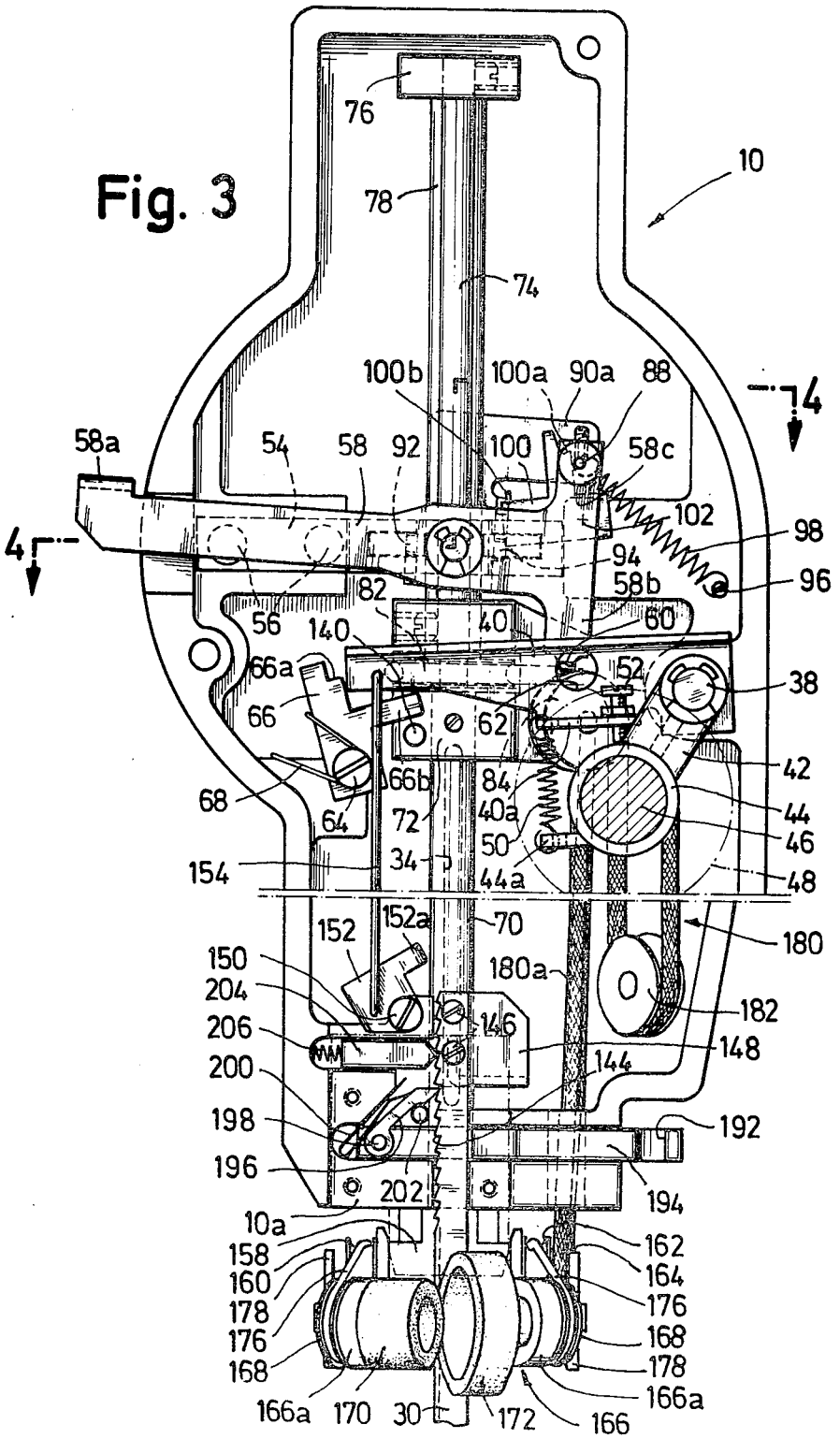
FIG. 3 is a section through the machine taken along the line 3—3 in FIG. 1 showing a view of a front housing shell from the inside including the machine parts mounted thereon.
Figure 4:
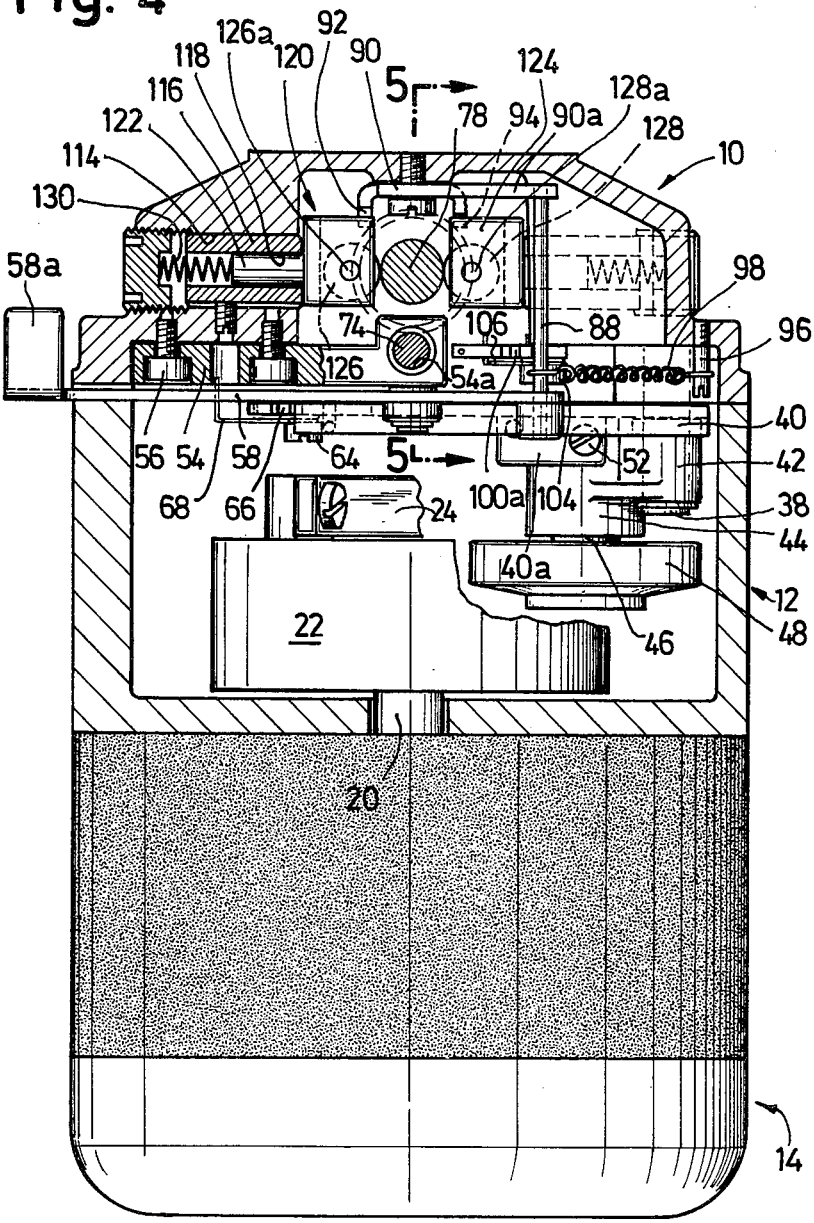
FIG. 4 is a section through the entire machine taken along line 4—4 in FIG. 3.

As shown in FIGS. 3 and 4, a bearing pin 38 with a lever 40 and a carrier arm 42 pivotally mounted thereon is secured to the inside of the front housing shell 10. Forming an integral part of the carrier arm is a bearing section 44 in which an axle 46 is mounted for rotation, said axle carrying a friction wheel 48 at the end facing the crank disc 22 and a pulley, not illustrated, at the opposite end—in front of the bearing section 44. Engaging a flange **40*a* of the lever 40 is a tension spring 50 whose other end engages an arm 44*a* secured to the bearing section 44 so that the tension spring attempts to pivot the carrier arm 42 upwardly in the direction of the lever 40. The position of the bearing section 44, can, however, be adjusted with respect to the lever 40 by a stop screw 52 which is screwed into a threaded bore in the flange 40*a* and whose lower end abuts the bearing section 44**.

A bearing section 54 with an actuating lever 58 mounted pivotally thereon is secured to the inside of the front housing shell 10 by means of screws 56 (see FIG. 4). This actuating lever extends with one end **58*a* through the housing and actuates with one arm 58*b* of its other T-shaped end the lever 40 by means of a projection 60 on the arm 58*b* engaging a hole 62 in the lever 40. Therefore, when the actuating lever 58 is pivoted in an anticlockwise direction, according to FIG. 3, it lifts the lever 40, and so the carrier arm 42 is also pivoted in a clockwise direction, according to FIG. 3, by the action of the tension spring 50, and the friction wheel 48 is brought into contact with the lower side of the crank disc 22. A stop lever 66 comprising a step 66*a* and an arm 66*b* is mounted for rotation by a screw 64 on the inside of the front housing shell 10. Associated with this stop lever is a helical spring 68 which attempts to pivot the stop lever 66 in a clockwise direction, according to FIG. 3, and thereby bring it into contact with the left end of the lever 40. It should be noted in this connection that the lever 40 and the stop lever 66 lie in the same plane. When the end 58*a* of the actuating lever 58 is pressed down, the projection 60 first of all lifts the left end of the lever 40 high enough to enable the stop lever 66 to pivoted in a clockwise direction by the helical spring 68 far enough for the step 66*a* to take up a position under the left end of the lever 40. During this pivotal movement of the lever 40 the friction wheel 48 is brought into contact with the crank disc 22 and the tension spring 50 is thereby subjected to tension. The stop lever 66 prevents the lever 40 from pivoting back and so the friction wheel 48 remains in contact with the crank disc 22**.

Figure 5:
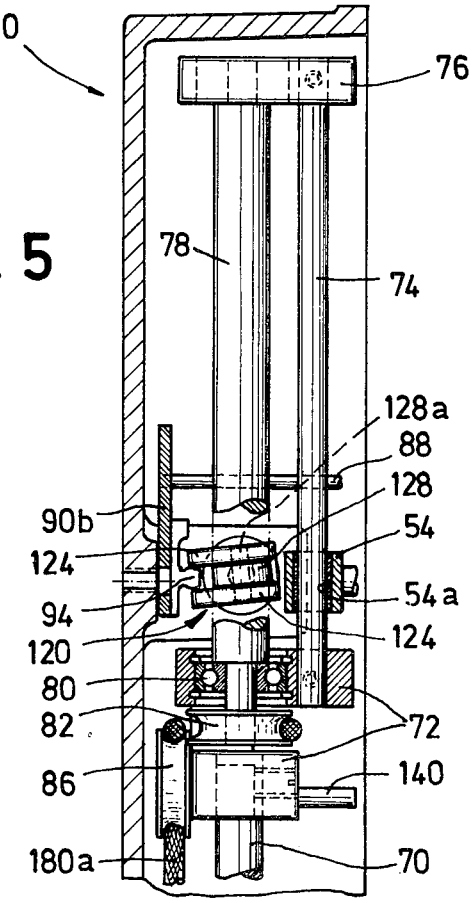
FIG. 5 is a section through the front housing shell and the machine parts mounted thereon taken along line 5—5 in FIG. 4.

A bore, not illustrated, with a carrier bar 70 guided therein for displacement in a vertical direction is located in a lower wall **10*a* (see FIG. 3) in the front housing shell 10. At the upper end of this carrier bar is a bearing section designated in its entirety 72, in which a guide bar 74 is, in turn, secured. The guide bar is guided in a bore 54*a* in the bearing section 54 for displacement in a vertical direction and carries at its upper end a further bearing section 76 in which the upper end of a feed spindle 78 is mounted for rotation with the help of a ball bearing, which is not illustrated in closer detail. As shown in FIG. 5, the lower end of the feed spindle 78 is mounted for rotation in the bearing section 72 by means of a ball bearing 80 and carries a pulley 82 via which the feed spindle 78 can be driven. Two further pulleys are, however, mounted for rotation on the bearing section 72, namely a rear pulley 84 on the side of the bearing section facing the interior of the housing, and a front pulley 86 (see FIG. 5) on the opposite side of the bearing section. Owing to the mounting in the lower wall 10***a* of the front housing shell 10 and in the bore 54*a* of the bearing section 54 secured to the front housing shell, the unit consisting of carrier bar 70, bearing section 72, guide bar 74, bearing section 76 and feed spindle 78 is therefore guided as a whole in the front housing shell 10 for displacement in a vertical direction and is prevented from rotating, since the axis of the bore 54*a* does indeed extend parallel to the axis of the bearing bore, not shown, in the lower wall 10*a*, but is offset relative thereto in the direction of the interior of the housing, as the guide bar 74 is also laterally offset relative to the carrier bar 70.

As is shown in FIG. 4, a pin 88 is secured to an upper arm 58*c* of the T-shaped end of the actuating lever 58 and engages a hole in the arm 90*a* of an angle lever 90, (see also FIG. 3) which with its other arm 90*b* is mounted for rotation on the inside of the front housing shell 10 (see FIG. 5). As is shown in FIGS. 4 and 5, the arm 90*b* carries two rounded off projections 92 and 94, whose purpose will be explained later. The ends of a tension spring 98 which constantly attempts to pivot the actuating lever 58 in a clockwise direction, according to FIG. 3, engage the pin 88 and a threaded pin 96, which is screwed into the front housing shell 10. Associated with the pin 88 is a stop lever 100 which is pivotable about an axis 102 indicated in FIG. 3 and defined by a screw 104 screwed into the front housing shell 10 (see FIG. 4). This stop lever is similarly subject to the action of a wire spring 106 which is held by the screw 104 and attempts to pivot the stop lever 100 in a clockwise direction, according to FIG. 3. The stop lever 100 comprises on the side facing the pin 88 a step 100*a* and also a small pin 100*b* which the bearing section 76 contacts in the course of the downward movement of the grinding device which will be described later.

As already mentioned, the step 66*a* takes up a position under the left end of the lever 40, as shown in FIG. 3, when the actuating lever 58 is pivoted downwardly, according to FIG. 3. In the course of the further pivotal movement of the actuating lever the pin 88 is lifted high enough for the step 100*a* of the stop lever 100 to be pivoted by the wire spring 106 under the pin 88. The left end of the lever 40 is indeed then raised above the step 66*a* of the stop lever 66, but this is not detrimental as the carrier arm 42 of the friction wheel 48 contacting the crank disc 22 is only connected to the lever 40 via the tension spring 50 and the upper end of the stop lever 66 then simply comes into contact with the left edge of the lever 40, as shown in FIG. 3.

As shown, above all, in FIG. 4, bushings 116 each comprising a bore 118 are screwed into bores 114, some of which are in the form of threaded bores, on either side of the front housing shell 10. Bearing section designated in their entirety 120 are pivotally and displaceably mounted in these bores 118 with the help of integral bearing pins 122. These bearing sections are of U-shaped cross-sectional configuration at the ends facing the feed spindle 78 (see FIG. 5) and form two bearing brackets 124, between which one friction wheel 126 and 128, respectively, is mounted for rotation by means of an axle 126*a* and 128*a*, respectively. These friction wheels are pressed against the circumference of the feed spindle 78 by compression springs 130 mounted in the bores 118, and in the embodiment shown the axes 126*a* and 128*a* are located exactly opposite each other with respect to the feed spindle, so that the feed spindle is not subjected to bending by the forces exerted by the compression springs 130. As shown, above all, in FIGS. 4 and 5, the projections 92 and 94 on the angle lever 90 extend between the bearing brackets 124 of the bearing sections 120 and thus determine the angular positions of the friction wheel axes 126*a* and 128*a*.

As shown particularly clearly in FIG. 5, the friction wheel axes 126*a* and 128*a* are inclined with respect to the axis of the feed spindle 78, and the position of the angle lever 90 determines the size and direction of this inclination. In the position of rest of the actuating lever 58, as shown in FIG. 3, the axis 128*a* of the friction wheel 128 is inclined, according to FIG. 5, in an anticlockwise direction with respect to the axis of the feed spindle 78, whereas the axis 126*a* of the friction wheel 126 is inclined by the same amount, but in the opposite direction, with respect to the axis of the feed spindle 78. If the feed spindle is driven in a clockwise direction, in accordance with FIG. 4, by means which will be described later, this inclination of the friction wheel axes 126*a* and 128*a* would result in the feed spindle 78 being raised if it were not already in its upper end position.

However, if the left end 58*a* of the actuating lever 58 is pressed down and the angle lever 90 is thereby pivoted in an anticlockwise direction, in accordance with FIG. 3, the inclinations of the friction wheel axes 126*a* and 128*a* are reversed with respect to the axis of the spindle 78, so that the friction wheel axis 128*a* is now pivoted in a clockwise direction, in accordance with FIG. 5, with respect to the feed spindle axis, and the friction wheel axis 126*a* in an anticlockwise direction—the latter does, of course, only apply when the axis 126*a* is observed in the same direction as in the sectional illustration shown in FIG. 5, i.e., from left to right in accordance with FIG. 4. The angle lever 90 is secured in the position it assumes by the pin 88 and the stop lever 100. When the frictional wheel axes 126*a* and 128*a* are inclined in the last above described manner, rotation of the feed spindle 78 in a clockwise direction, in accordance with FIG. 4, results in the feed spindle and consequently also the carrier bar 70 being lowered.

If the feed spindle has been lowered so far that the bearing section 76 comes into contact with the pin 100*b* of the stop lever 100, upon further rotation and thus further lowering of the feed spindle 78 the stop lever 100 is pivoted in an anticlockwise direction, in accordance with FIG. 3, and its step 100*a* is pulled out from underneath the pin 88. The tension spring 98 then pivots the actuating lever 58 in a clockwise direction, in accordance with FIG. 3, back into its initial position, and owing to the coupling via the pin 88, the angle lever 90 is simultaneously likewise pivoted back in a clockwise direction, in accordance with FIG. 3, into its indicated initial position. A reversal of the feed direction is thereby effected, and so further rotation of the feed spindle 78 in a clockwise direction, in accordance with FIG. 4, results in the feed spindle and consequently the carrier bar 70 being raised.

Secured to the bearing section 72 is a pin 140 shown in FIG. 3, which at the end of the upward movement of the carrier bar 70 comes into contact with the arm 66*b* of the stop lever 66 and pivots the latter in an anticlockwise direction, in accordance with FIG. 3, counteracting the action of its helical spring 68, so far that the step 66*a* is pulled out from underneath the left end of the lever 40. Since, as described above, the actuating lever 58 has already fallen back into its position of rest shown in FIG. 3, the lever 40 can be pivoted in an anticlockwise direction, in accordance with FIG. 3, so that the friction wheel 48 pivots downwardly around the bearing pin 38 by the action of an elastic drive rope to be described later, and moves away from the crank disc 22.

The bar 30 carrying the material presser foot 28 comprises on one side toothing 144 of saw-toothed configuration. At the upper end of the bar 30 there is secured by means of screws 146 a bracket 148 which carries the handle 32 and in the lower end position of the material presser foot 28 comes into contact with the lower wall 10*a* of the front housing shell 10. Mounted for rotation at the front housing shell 10 with the help of a screw 150 is a locking lever 152 coupled with the lever 40 via a connecting part 154 such that when the end 58*a* of the actuating lever 58 is pressed down, the locking lever 152 is pivoted in a clockwise direction, in accordance with FIG. 3. If the material presser foot 28 is not at least almost in its lower end position, the bar 30 prevents such a pivotal movement on the part of the locking lever 152 by way of a projection 152*a* on the locking lever extending into the path of the bar 30, so that the friction wheel 48 does not come into contact with the crank disc 22 and therefore the drive means for the grinding device to be described later cannot be actuated. If, however, the material presser foot 28 is in its lower end position as is the case in the drawings, the locking lever 152 can pivot in a clockwise direction, in accordance with FIG. 3, and thus the end 58*a* of the actuating lever 58 can be pressed down. Secured to the lower end of the carrier bar 70 is a bearing section designated in its entirety 158, in which an axle, not shown, carrying at one end a pulley 160 and at its other end two pulleys 162 and 164 is mounted for rotation. Pivoted at this bearing section 158 are two carrier arms 166, not illustrated in detail, which are pivotal around vertical axes and extend from their pivotal point in a rearward direction towards the oscillating knife 26. Axes whose outer ends carry pulleys 168 and whose inner ends carry grinding wheels 170 and 172 are mounted for rotation in the front ends 166*a* of these carrier arms shown in FIG. 3. The grinding wheel 172 is cup-shaped and so the outer part of the grinding wheel 170 can extend into the grinding wheel 172. Springs which are not illustrated serve to pivot the carrier arms 166 and thus the grinding wheels 170 and 172 towards each other. When the pulley 164 is driven, drive belts 176 cause the grinding wheels 170 and 172 to rotate. Pins 178 mounted on the bearing section 158 and shown in FIGS. 1 and 2 serve to prevent the drive belts 176 from flying off the pulleys 160, 162 and 168 when the carrier arms 166 pivot away from each other, which is a special advantage of the inventive construction.

A single lengthwise elastic drive rope 180 extending with a first flight 180*a* from the pulley, not shown, secured to the axles 46 of the friction wheel 48 downwardly to the pulley 164 and from there upwardly to the front pulley 86 on the bearing section 72, serves to drive the grinding wheels 170 and 172 and also the advancing device for the grinding device. The pulley 86 serves solely to deflect the drive rope which then winds around the pulley 82 driving the feed spindle 78 through an angle of approximately 180° and from there extends over the rear pulley 84 of the bearing section 72 where it is deflected downwardly. From there the drive rope runs over a pulley 182 mounted stationarily in the housing for rotation on the inside of the front housing shell 10 and finally extends upwardly again to the pulley, not shown, located on the axis 46 of the friction wheel 48.

Figure 6:
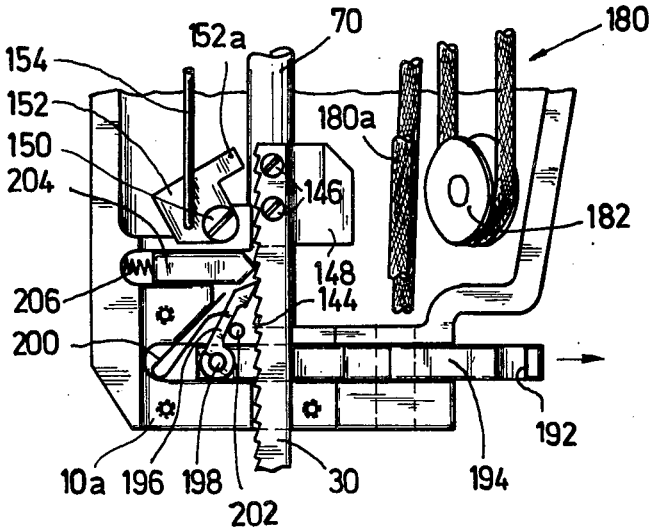
FIG. 6 is a section of FIG. 3 in the lower region of the front housing shell to illustrate the function of an actuating means for the material presser foot.
Figure 7:
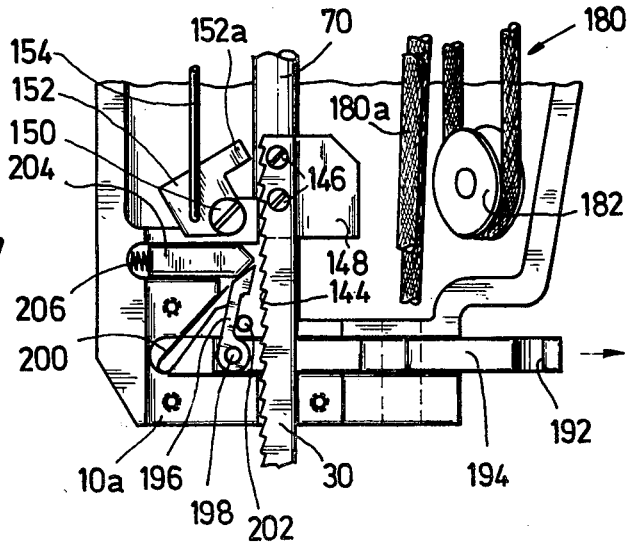
FIG. 7 is a view similar to FIG. 6 illustrating a different relative position to the parts.

As shown in FIG. 2, an actuating lever 186 is mounted on the rear housing shell 12 for pivotal movement around a vertically extending axle 188. The rear end of this actuating lever is adjacent to a handle 190 secured to the housing shell 12, while the front end of the actuating lever 186 comprises a slit and a pin, not shown, engaging a rearwardly open slit 192 in a slide 194 displaceably guided in its longitudinal direction in the front housing shell 10 (see FIGS. 3, 6 and 7). When the rear end of the actuating lever 186 is brought closer to the handle 190 counteracting the action of a spring, not shown, this therefore results in the slide 194 being pulled out to the right of the front housing shell 10, in accordance with FIGS. 3, 6 and 7.

At the inner end of the slide 194 a pawl 196 is mounted for pivotal movement on a pin 198 carried by the slide. This pawl is forced by a leaf spring 200 held in a corresponding recess in the front housing shell 10 into the toothing 144 on the bar 30 or against a stop pin 202 secured in the front housing shell 10. A detent slide 204 which is likewise forced into the toothing 144 on the bar 30 by the action of a compression spring 206 is mounted for displacement in a transverse direction in a corresponding recess in the front housing shell 10. In accordance with the invention, the slide 194 and the detent slide 204 do, however, interact in such a way that the detent slide is forced out of the toothing 144 when the actuating lever 186 is brought into the relatively remote proximity of the handle 190. In a preferred embodiment of the inventive cutting machine this coupling is effected via the pawl 196 which also serves to lift the bar 30, and consequently the material presser foot 28, in a stepwise manner. For when the actuating lever 186 is pivoted, which can be done by the hand of the attendant in which the handle 190 is held, the pawl 196 first of all displaces the bar 30 one tooth space higher owing to the stop pin 202, and when the actuating lever 186 is then released again, the bar 30 is held in its new position by the detent slide 204. If, however, the free end of the actuating lever 186 is brought even closer to the handle 190 after the bar 30 has been advanced, the upper end of the pawl 196 comes into contact with the sloped front end of the detent slide 204, and when the slide 194 is pulled further out of the front housing shell 10, forces the detent slide towards the left, in accordance with FIGS. 6 and 7, so that the toothing 144 is finally released from both the pawl 196 and the detent slide 204. The bar 30 and the material presser foot 28 are then forced to fall down by their own weight.

Therefore, the inventive construction does not only enable controlled lifting of the material presser foot 28 with the hand guiding the cutting machine, but, in addition, the material presser foot can be lowered with the same hand. Consequently, the inventive cutting machine features genuine one-hand and one-lever operation as far as lifting and lowering the material presser foot are concerned.

Finally, when the outer end 58*a* of the actuating lever 58 is pressed down and the friction wheel 48 comes into contact with the crank disc 22, the lengthwise elastic drive rope 180 is expanded somewhat, namely by the amount of the upward displacement of the axis 46, and owing to the lengthwise elasticity of the drive rope 180, the latter can also be used as a restoring spring for the carrier arm 42 and the lever 40, which also ensures that the friction wheel 48 does not touch the crank disc 22 when the drive means is in its position of rest.

Having thus described my invention, I claim:

1. A cutting machine comprising a motor mounted in a housing for driving a lengthwise oscillating knife extending in a substantially vertical direction, further comprising a material presser foot mounted on a carrier bar extending in the longitudinal direction of the knife and displaceably guided in this direction at the housing, and also comprising an actuating member mounted on the housing for releasing a support means for the carrier bar, characterized in that the actuating member (186) is also coupled with a lifting device (196) for lifting the carrier bar (30) in a stepwise manner.

2. A cutting machine as set forth in claim 1, characterized in that the actuating member (186) is adjustable from a position of rest to a second position via an intermediate position, the support means (204, 206) being released in said second position, and in that the lifting device (196) is actuatable by moving the actuating member (186) from its position of rest to the intermediate position.

3. A cutting machine as set forth in claim 1, characterized in that the lifting device comprises a pawl (196) actuatable by the actuating member (186) and engaging toothing (144) on the carrier bar (30).

4. A cutting machine as set forth in claim 1 characterized in that the support means (204, 206) is actuatable and releasable by the lifting device (196) when the latter effects a stroke which exceeds the normal stroke.

5. A cutting machine as set forth in claim 4, characterized in that upon effecting a stroke which exceeds the normal stroke the pawl (196) disengages the toothing (144) of the carrier bar (30) and releases the support means (204, 206).

6. A cutting machine as set forth claim 1, characterized in that the support means (204, 206) comprises a projection (204) engaging the toothing (144) of the carrier bar under the effect of a spring (206).

7. A cutting machine as set forth in claim 6, characterized in that upon effecting a stroke which extends a normal stroke the pawl (196) abuts the projection (204) and raises the latter out of the toothing (144) of the carrier bar.

8. A cutting machine as set forth claim 1 comprising a handle extending in a direction away from the housing, characterized in that the actuating member is a lever (186) extending in the same direction as this handle (190).

9. A cutting machine as set forth in claim 1, further comprising a displaceable grinding device, means mounted at the housing for guiding said grinding device in the longitudinal direction of the knife, said gripping device having at least one grinding element which can be brought into contact with a side surface of the cutting edge of the knife, said grinding element being made to circulate by a drive means coupled to the motor, characterized in that a locking device (152) adjustable between an operative and an inoperative position is provided for the drive means (48,480) so as to only assume its inoperative position when the material presser foot (28) is fully lowered.

10. A cutting machine as set forth in claim 9, characterized in that the locking device (152) comprises a projection (**152*a*) which when the locking device is in its inoperative position extends into the path of the material presser foot bar (30**).

* * * * *

UNITED STATES PATENT AND TRADEMARK OFFICE

CERTIFICATE OF CORRECTION

PATENT NO. : 4,195,404

DATED : April 1, 1980

INVENTOR(S) : Walter Schweitzer

It is certified that error appears in the above-identified patent and that said Letters Patent are hereby corrected as shown below:

Column 12, line 8, "extends" should read -- exceeds --;

line 20, "gripping" should read -- grinding --.

Signed and Sealed this

*Twenty-fourth* Day of *June 1980*

[SEAL]

*Attest:*

SIDNEY A. DIAMOND

*Attesting Officer*

*Commissioner of Patents and Trademarks*